United States Patent [19]

Abbey

[11] 4,369,916

[45] Jan. 25, 1983

[54] ENERGY SAVING OVERRIDE BLOWER CONTROL FOR FORCED AIR SYSTEMS

[76] Inventor: Dean M. Abbey, 1312 Wood, Lansing, Mich. 48912

[21] Appl. No.: 202,886

[22] Filed: Nov. 3, 1980

[51] Int. Cl.[3] ..... F24N 19/10

[52] U.S. Cl. ..... 236/11; 361/394

[58] Field of Search ..... 236/10, 11; 62/186; 361/394, 415

[56] References Cited

U.S. PATENT DOCUMENTS

| | | | |
|---|---|---|---|
| 1,546,450 | 7/1925 | Meaker | 236/10 X |
| 1,558,848 | 10/1925 | Boble, Jr. | 236/10 X |
| 3,691,432 | 9/1972 | Edfors et al. | 361/394 X |
| 3,912,162 | 10/1975 | Bauer et al. | 236/11 |
| 3,961,200 | 6/1976 | Dute | 361/394 X |
| 4,013,219 | 3/1977 | Jacobson | 236/46 R |
| 4,090,663 | 5/1978 | Bonne | 236/10 |
| 4,215,386 | 7/1980 | Prager et al. | 361/394 |

*Primary Examiner*—William E. Tapolcai

*Attorney, Agent, or Firm*—Miller, Morriss and Pappas

[57] ABSTRACT

A blower override system and control for forced air systems such as heating or cooling systems in which an override relay starts the blower to circulate the warmed or cooled air when the heating or cooling element turned on. When the heating or cooling is turned off, the blower is thereupon allowed to continue by the override unit to function for a timed interval by a time dclay relay. The unit is in a control box and ready to attach to existing control structures for forced air systems.

2 Claims, 4 Drawing Figures

ENERGY SAVING OVERRIDE BLOWER CONTROL FOR FORCED AIR SYSTEMS

The present invention is directed to a blower override system and control for forced air heating systems wherein a relay, activated by the ignition and supply function of fuel to the burner as, for example, tripped by a thermostat, starts the blower and extends performance of the blower until the burner is turned off and then, via a time delay, continues the blower function for a selected time period. The same unit is operable with air conditioning blower units with equivalent savings.

No interference with regular controls is required and the regular controls serve as a fail-safe back up. The regular controls alone trip the blower at a preset temperature level in the plenum or at the thermostat and results in substantial heat loss to the stack, both before and after the heat cycle. The regular controls stop the plenum blower with the stopping of the burner. The present invention is directed to a device which starts the blower at the onset of heat and continues the blower operation for a time interval after the burner is turned off.

BACKGROUND OF THE INVENTION

In modern furnaces of the forced air heating type (oil, gas, electric, hot water, and steam), it is usual for the controls to initiate the burner or heater function and thereafter, upon achieving a thermal set condition, for example in the plenum or heat ducts, to then initiate the blower function. The heat cycle continues until the house thermostats reach the upper set point and the controls stop the hot air blower and the heat source or furnace. Actually, heat is increasing in the plenum over ambient air conditions substantially at the instant of application of the heat source as, for example, from combustion in the furnace and the heat is residually retained in the plenum or heat exchangers after the furnace is turned off and until the heat surfaces reach ambient temperatures.

Regular controls do not treat the situation at start-up by starting the warm air blower and do not treat the situation, as in the present invention, to strip the residual heat after furnace shutdown. Without the present invention, substantial loss of available heat occurs directly up the chimney and as a consequence causes sucking of combustion air into the house or area heated upon commencement of combustion and before commencement of the plenum blower.

Investigations conducted to determine the amount of heat saving have been extraordinarily encouraging and when the contribution of the present invention is compared against regular controls, the forced air heating systems in which the present invention has been utilized have demonstrated substantial savings of heat and consequent economy to the users. As applied to gas furnaces, the electric consumption held level and a gas savings of about 27,000 cubic feet resulted in a heating season. Maximum savings is realized when the increase in unit costs of gas and oil are contemplated. This is also true because the gradual heat rise at the start of the cycle and the relatively high thermal residuals at shutdown are utilized. The system is applicable to gas fired, oil fired, and electric warm air furnaces as well and on the basis of these findings it is possible to anticipate a fuel savings of between about seven to thirty percent over the experiences of regular controls of varying sophistication. These accomplishments require no physical alteration of existing forced air heating plants and with the present invention this is achieved by simple addition to existing controls.

PRIOR ART DISTINGUISHED

In 1977 the U.S. Pat. No. 4,013,219 issued to James Jacobson and in that structure a thermostat was modified to include a timer. This device was a manually actuatable timer and its objective was an override for all controls which, then, required manual reset.

The U.S. Pat. No. 4,090,663 to Ulrich Bonne, et al. is directed to a fan control functioning on the basis of a heat differential between plenum and the return air temperature.

None of the known devices provide an automatic blower control system capable of preventing heat loss at the ends of a heating cycle in forced air systems.

While both prior art systems of control seek to achieve an energy savings, they attack the problem of juggling the thermal input based upon selected operating optimums or in accord with manual selection of applications of heat. Neither propose a simple and automatic system and control applicable to all forced air systems and where the regular controls may remain intact and perform their regular function.

Accordingly, the principal object of the present invention is to provide an energy conserving device attachable to existing furnace or heating system controls of the forced air type which automatically function.

Another object is to teach energy savers of the control of energy loss via the blower and permitting the blower to start on introduction of combustion gases or heat source to the surfaces over which the blower operates.

Other objects, including simplicity, ease of repair and repetitive accuracy, will be apparent as the application proceeds.

GENERAL DESCRIPTION

In general, the present invention is an override control for forced air heating and air conditioning systems and which exercises control over the air blower which delivers warm or cool air. The greatest saving of energy is in the heating field, but energy saving is apparent in air conditioning cycles as well. The control and system comprises an electric activating circuit which starts the blower when the heat media (as a burner) or cooling media (as a compressor or thermal source) is activated. The activating circuit, as applied to forced warm air, is in parallel with an override relay so that upon actuation of the activating circuit by normal controls, the override relay is activated and starts a warm air blower. A time delay relay which acts upon the override relay is connected for actuation upon cessation of flow of heat media source and provides an adjustable time interval in prevention of deactivation of the activating relay after discontinuance of the heat or thermal source. This keeps the blower working for the timed interval and thereafter the time delay relay deactivates the blower from moving warmed air. While applicable to forced cold air systems, the structure and control can be appreciated easiest where the heat media source is considered as a burner. Then the system is an override control for forced air and in control of a warm air blower having an electric thermal control circuit. An activating circuit initiated by the starting of the burner is provided. An override relay is connected in parallel to the burner circuit and this is activated when the burner circuit is activated and starts a warm air blower in the forced air system. A time delay element upon the override relay in adjustable timed interval in prevention of deactivation of the relay after discontinuing the burner performance. The time delay deactivates the warm air blower upon completion of the timed interval after discontinuance of the thermal source.

While heat installations are referred to, the devices and system of the present invention are equally useful in distributing cold, as from an air conditioner device, so that the blower is started with the compressor or cold thermal source flow and continues for a timed interval beyond cessation of movement of the cooling media.

IN THE DRAWINGS

SPECIFIC DESCRIPTION

Figure 1:
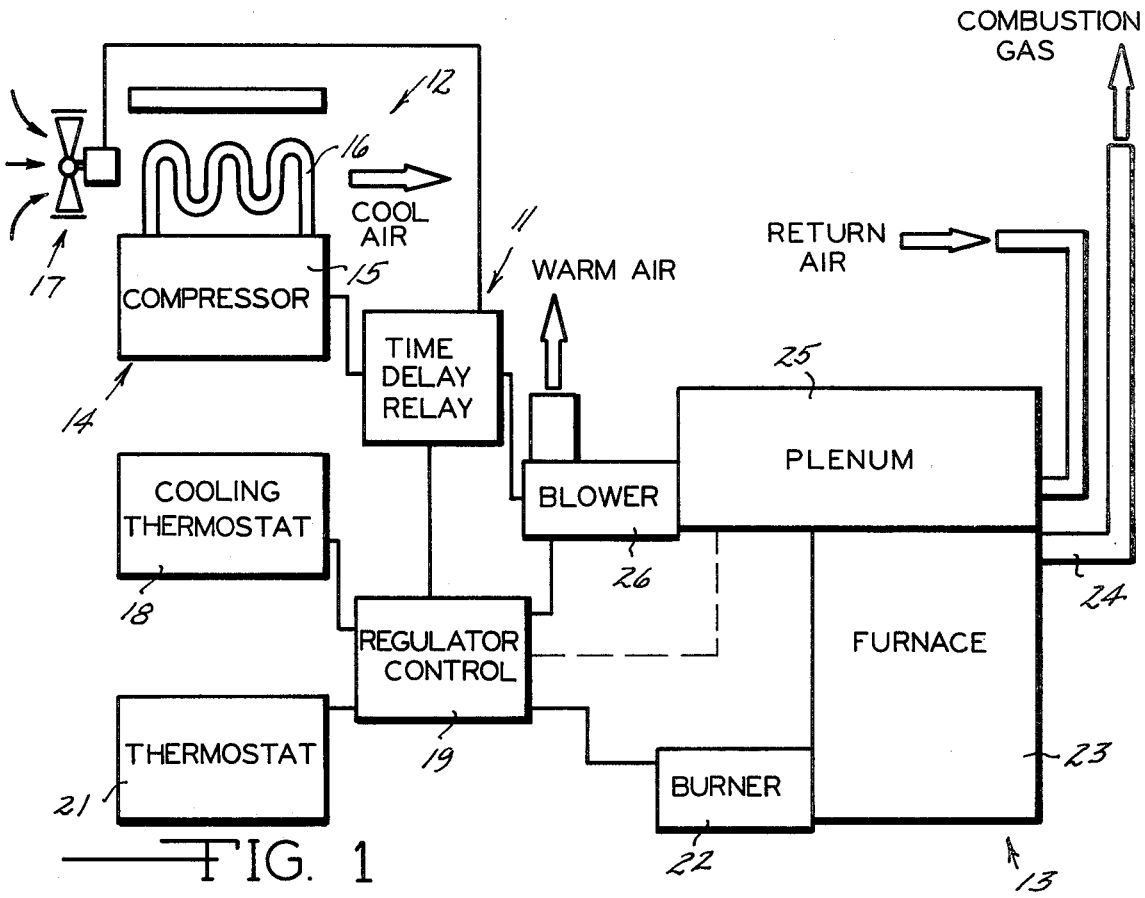
FIG. 1 is a schematic block diagram of an override control in a conventional gas or oil fired furnace and functions with regular controls to achieve the fuel saving result of the present invention.

Referring with first particularity to the FIG. 1, there is schematically shown the location of the energy saving override blower control system 11 and it is shown connected to an air conditioning cooling system 12 and to a heating system 13. The arrangement is characteristic of combining heat and air conditioning installations using common controls. The compressor 14 may be regarded as the source of cooling thermal energy. The coolant media 15 as, for example, ammonia, brine or other coolant compounds pass from the compressor 14 and into the coolant coils 16 with ultimate return to the compressor 14. A coolant blower or fan 17 forces air over the coil 16 and into the space such as a dwelling where the cool air drops the temperature and returns to the fan or blower 17 for recirculation. The cooling thermostat 18 is a part of the regular controls 19 signalling within appropriate operating range the energization of the compressor 14. At its lower set point, the cooling thermostat shuts off the compressor 14 and with it the fan or blower 17. Using regular controls 19, the fan 17 is initiated when the compressor turns on and runs until the thermal condition 20 achieves a set point. Using ordinary or regular controls 19, the cooling system does not commence circulation until the set point is achieved. In the heating system 13 served by the regular controls 19, the thermostat 21 (heat) signals the demand for heat and the heat source, such as burner 22 (gas, oil, electricity), is started in the furnace 23 as by combustion and the exhaust combustion gases travel from the stack and out of the house or heated enclosure. Air in support of the combustion enters the burner 22 from ambient air or outside air. The heat generated by the combustion in furnace 23 is exchanged to air via the exchange surfaces of the plenum 25. When the plenum 25 reaches a selected heat set point, the blower or fan 26 is started which pumps the warmed air into the house or heated enclosure. The starting condition using regular controls 19 is the thermal set point established in the plenum 25. Using the regular controls 19, the function of the heating and the cooling are as described until the energy saving override blower control 11 for forced air systems with time delay is superimposed. The override blower control 11 with time delay relay is activated when the thermal source, such as compressor 14 or burner 22, is started and this starts the blowers or fans 17 and 26 in accord with the commencement of the regular controls 19 as by the heating thermostat 21 or the cooling thermostat 18 responding to the set conditions in the home or enclosure. The blowers 17 or 26 continue to run until the time delay relay in the override control 11 adds its timed interval of performance (usually selected between two and five minutes) after the compressor 14 or burner 22 is stopped. This strips the residual heat or cold and distributes it in the house or enclosure beyond the shutdown called for by the thermostats 18 and 21. An evener thermal condition is brought about and the energy which would otherwise waste to an external environment is utilized and the interval between burner activations is extended.

Figure 2:
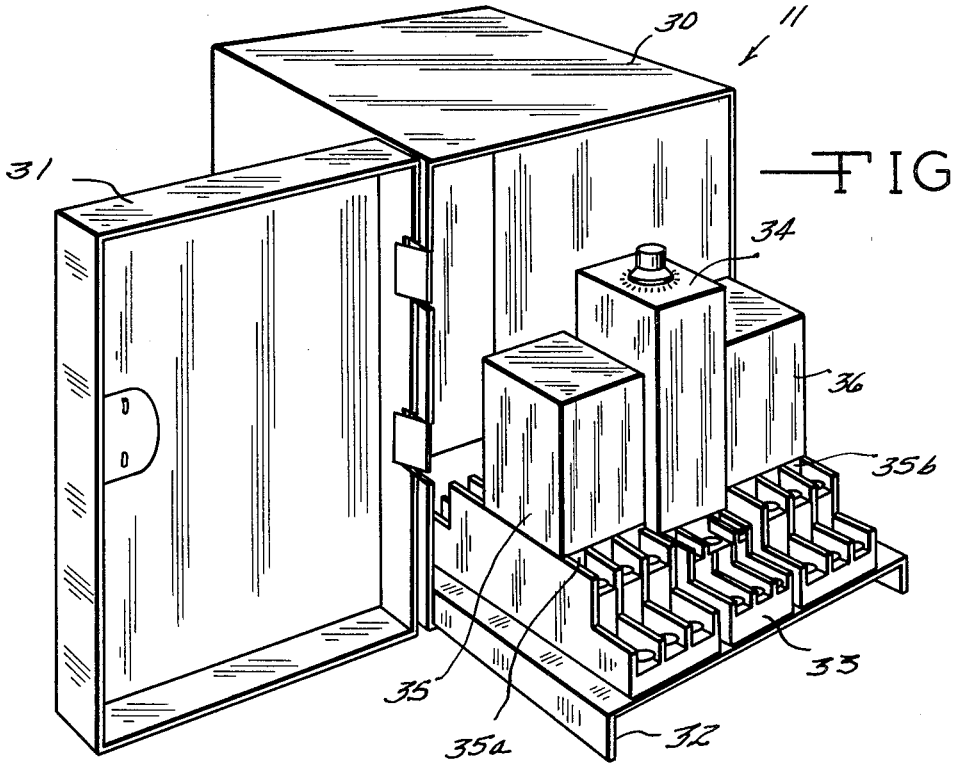
FIG. 2 is a perspective view of the control of the present invention in a simple circuit box.

The override control 11 is better understood by examining its simple construction as set out in FIG. 2. The entire control 11 is enclosed in a simple control box 30. The box 30 is a metal Underwriter approved enclosure with a hinged cover 31 and with knock-out windows on all sides to suit varied installation situations. A channel shaped chassis platform 32 is slidably positioned in the box 30 in whatever position is convenient since the box 30 is rectangular and of a depth equal to the depth of the platform 32 allowing inversion of the box 30 to shift the hinged cover to left or right openings. Eight colored leads extend from the box 30 and are color coded to their end uses for ease of field installation. The leads (FIG. 4) are connected to the control elements as will be appreciated as the description proceeds.

Centrally connected to the chassis platform 32 is an 11 pin octal socket 33 coded 6×156 and rated at 10 amps and 300 volts alternating current. It is Underwriter Laboratory Listed as E40944. The socket 33 provides the 11 pin octal receptacle for plug-in enclosed (off delay) double pole, double throw relay 34 of the adjustable delay type adjustable between 2 and 300 seconds (5 minutes) coded 6×155 and bearing Underwriter Laboratory Listing E40944.

Flanking the time delay relay 34 are the override relays 35 and 36. These are single pole double throw type relays and are coded 5×834 and 15×835, respectively, at 13 amps and relay 35 operates at 24 volts for control of a gas valve or for a 24 volt air conditioning relay and bears Underwriter Laboratory Listing E356730. Relay 36 operates at 120 volts alternating current and is for a 110 volt alternating current gas power burner and oil relays. The relay 36 also bears the Underwriter Laboratory Listing E56730. These relays 35 and 36 are regarded as the override relays and serve to start the fans or blowers 17 and 26 when the regular controls start the air conditioning or burner units, respectively. While both 24 volt and 120 volt override relays are provided, a selection will have to be made according to what the actuating circuit provides.

Identical 11 pin sockets **35*a* and 35*b* provide the socket mounting means for the plug-in relays 35 and 36, respectively. The sockets 35*a* and 35*b*** are coded 5×853 rated at 10 amperes and 300 volts alternating current and bear Underwriter Laboratory Listing E40944.

In the compact arrangement shown, as where a heating and air conditioning unit are both served by the same override blower controller unit 11, the time delay relay 34 is in the mounting socket 33 and the socket 33 is secured firmly to the chassis 32. The flanking sockets 35*a* and 35*b* are generally in adjacent aligned relation to the socket 33 and are secured to the chassis 32.

Figure 3:
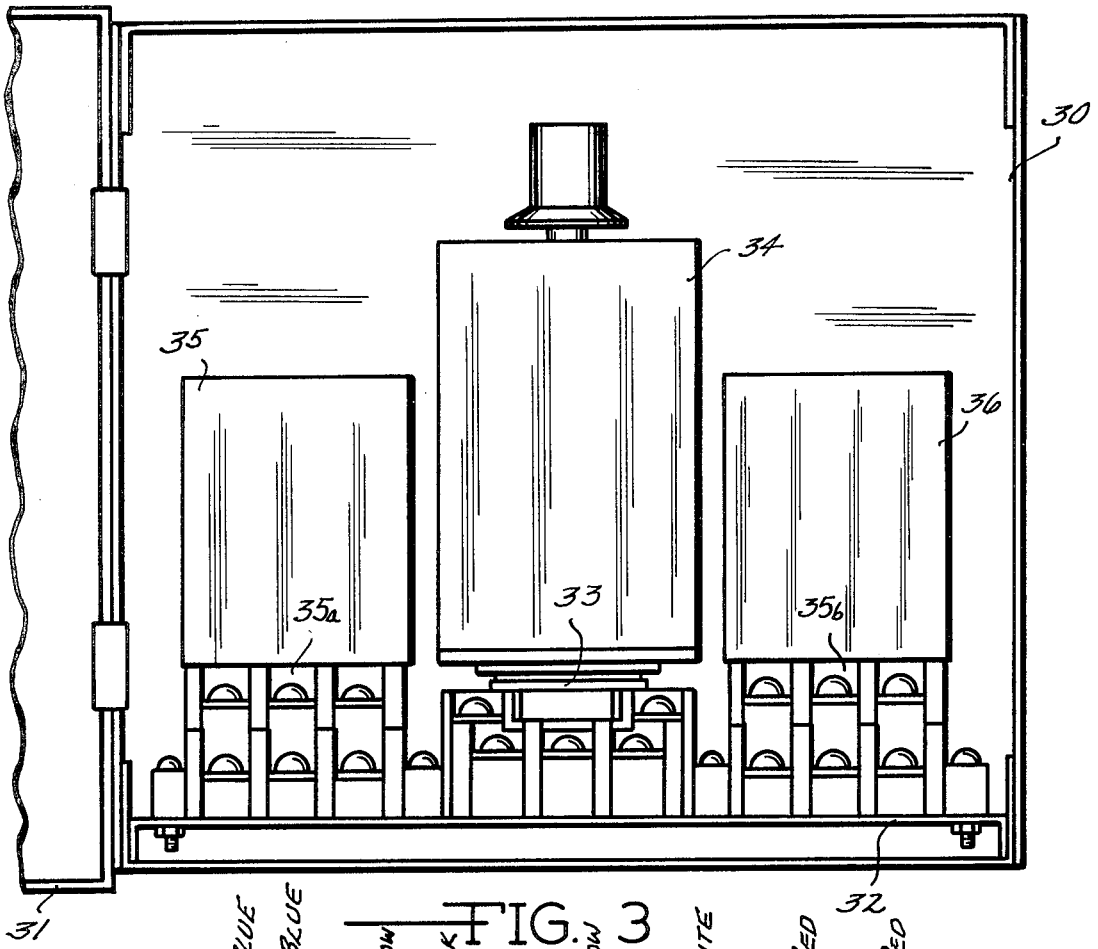
FIG. 3 is a front elevation view of the embodiment of the invention seen in FIG. 2.

In FIG. 3 the override blower control is indicated as secured in place in the control box 30, as viewed upon opening the box.

Figure 4:
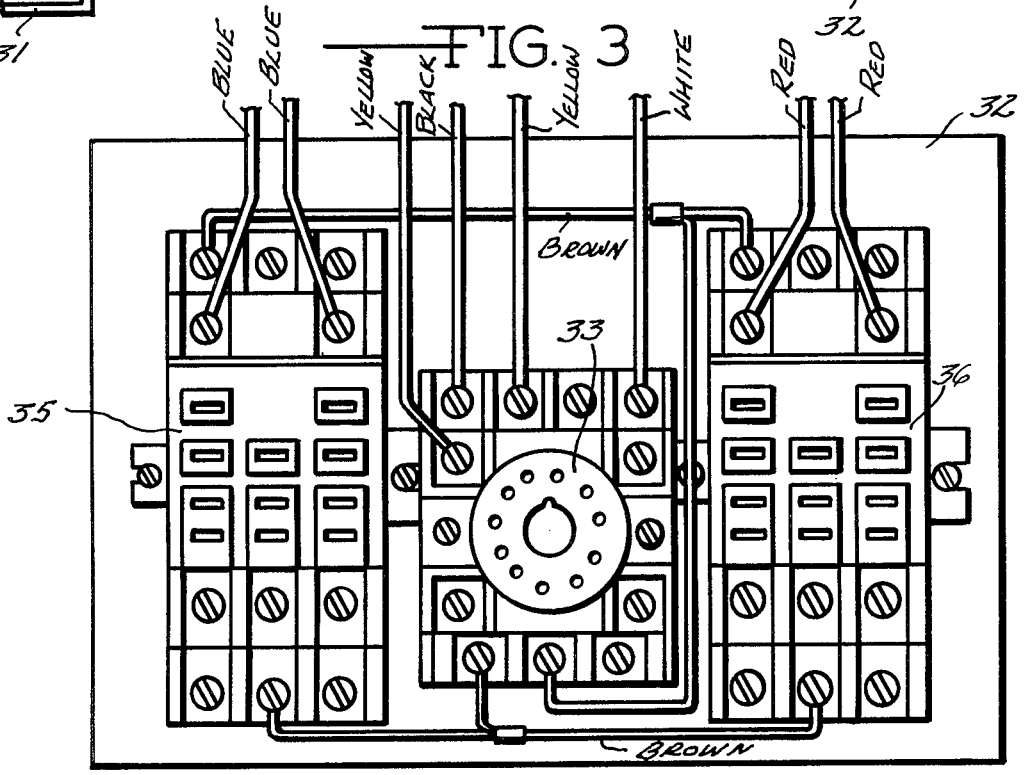
FIG. 4 is a top plan view of the structure of FIG. 3.

By reference to FIG. 4, factory wiring as between the units 34 and 35 and 36 is installed as indicated and these leads in heavy line are preferably fixed at the factory in avoidance of tampering. These leads interrelate the relays 35 and 36 to the time delay relay 34 so that the time delay relay assures that the blowers 17 and 26 will function at start of the compressor 14 or burner 22 and will continue that functioning until the timed interval of the relay 24 is complete.

In the FIG. 4 the leads are shown (as color coded) extending from the rear of the platform 32 and from the interlocked pin socket receptacles 35*a* and 35*b* and the central time delay relay mounting socket 34. As will be appreciated, the override relays 35 and 36 are easily removed and replaced for servicing and the time delay element 34 is also easily removed and replaced as necessary. The wiring remains intact and the interval timing is imposed on the blowers after the thermal source (heater or air conditioner) has been stopped. After the timed interval, the blowers are shut down but the heat has been stripped and delivered to the living space to avoid heat loss up the chimney and the cold has been normalized by supplying the residual cooling to the served space in the home or use premises at a substantial savings of energy.

In FIG. 4 the override blower control 11 is indicated as applied to a furnace and an air conditioning unit in control over the blowers of each. When control is sought only over one of the units, then only one relay need be used. The time delay relay 34 is connected to a source of power serving the furnace and/or the air conditioner and including the blowers therefor. In both, the distribution blowers come on when the burner and/or compressor starts. Then, when the thermal set points have been achieved, the blowers stop with cessation of heating or cooling. At that point, the time delay relay 34 connected to power ahead of the furnace 23 or air conditioner 12 acts upon the relays 35 and 36 and holding the function of the blowers.

By reference to FIG. 4, the brown wires or leads connecting the relays 34, 35 and 36 are factory installed and, as shown, both the heating unit relay and the air condition relay are provided. If only override control over the air conditioner or heating is required, then one of the relays 35 and 36 may be eliminated.

The two red wires are useable across the burner or gas valve relay 36 if a gas valve relay is used in the heating circuit or otherwise to the burner ignition if oil or electric heat are used. It is, of course, necessary to determine if the voltage is 110 volts or 24 volts.

The two blue wires are across the air conditioning relay 35.

The two yellow wires or leads are to the terminals across the blower control in the regular controls 19.

The lead colored black is attached to the hot line of the furnace or thermal system served and the white wire is to the ground of the furnace or thermal system served. Thus coded, field installation is vastly simplified and adapts the override control 11 to myriad control circuits as found in heating and air conditioning installation. Basically the override control 11 is wired in parallel.

Where plural speed blower or fan operation is desired, it will be appreciated that additional override controls 11 may be required for each operational level.

Noteworthy is the point that the structure of the present invention, once installed, is adjustable via the time delay relay to a selected operating period after cessation of the thermal source by reason of the selected holdover period in the time delay relay 34. The optimum time selected should be that period of time where the thermal residuals are fully delivered to the dwelling space or use space. Energy saving economies are obvious since the thermal residuals are used rather than exhausted to external atmosphere.

No changes are required in the existing control wiring.

Having thus described my invention and one operative embodiment thereof, those skilled in the art will appreciate changes, modifications and improvements therein and such changes, modifications and improvements are intended to be embodied herein limited only by the scope of my hereinafter appended claims. As will be appreciated, the electrical components thus described may be substituted for by suitable electronic or solid state equivalents without departure from the spirit of the present invention and such modification is contemplated in my hereinafter appended claims.

I claim:

1. An overide control element wired for connection to regular thermal controls to heating and air conditioning blowers comprising:

a control box;

a chassis in said control box;

a time delay relay support socket secured to said chassis;

a time delay relay on said time delay relay support socket;

an override relay socket separate from said time delay relay support socket;

at least one override relay on override relay socket;

wiring integrating said time delay relay with said override relay; and leads for operable connection of said relays to said regular thermal control and to blowers served thereby whereby said blowers are activated upon energization of said regular controls and are continued for a selected interval beyond de-energization of said regular controls.

2. In the override control element of claim 1 wherein plural override relays are employed at selected operating voltages.

* * * * *